United States Patent [19]

Guillon

[11] 4,044,654

[45] Aug. 30, 1977

[54] HYDRAULIC ENGINE

[75] Inventor: Marcel F. Guillon, Issy-les-Moulineaux, France

[73] Assignee: D. B. A., Clichy, France

[21] Appl. No.: 701,579

[22] Filed: July 1, 1976

Related U.S. Application Data

[63] Continuation-in-part of Ser. No. 558,559, March 14, 1975, abandoned.

[30] Foreign Application Priority Data

Mar. 27, 1974 France ..... 74.10489

[51] Int. Cl.[2] ..... F01B 13/04

[52] U.S. Cl. ..... 91/499

[58] Field of Search ..... 91/499–507; 417/269–274, 264

[56] References Cited

U.S. PATENT DOCUMENTS

| | | | |
|---|---|---|---|
| 2,357,563 | 9/1944 | Truxell, Jr. | 417/269 |
| 3,818,803 | 6/1974 | Pearson et al. | 91/499 |

FOREIGN PATENT DOCUMENTS

| | | | |
|---|---|---|---|
| 854,128 | 1/1940 | France | 417/276 |
| 1,060,300 | 11/1953 | France | 417/274 |
| 988,525 | 8/1951 | France | 417/264 |
| 1,099,357 | 2/1961 | Germany | 417/269 |
| 436,873 | 1/1948 | Italy | 417/269 |
| 297,542 | 3/1954 | Switzerland | 417/269 |

*Primary Examiner*—William L. Freeh

*Attorney, Agent, or Firm*—Stevens, Davis, Miller & Mosher

[57] ABSTRACT

A hydraulic engine of the type working between a high pressure and a low pressure and comprising working chambers and mobile elements movable in said working chambers, wherein means are provided for connecting said working chambers in turn with the low pressure source.

3 Claims, 2 Drawing Figures

HYDRAULIC ENGINE

Figure 1:
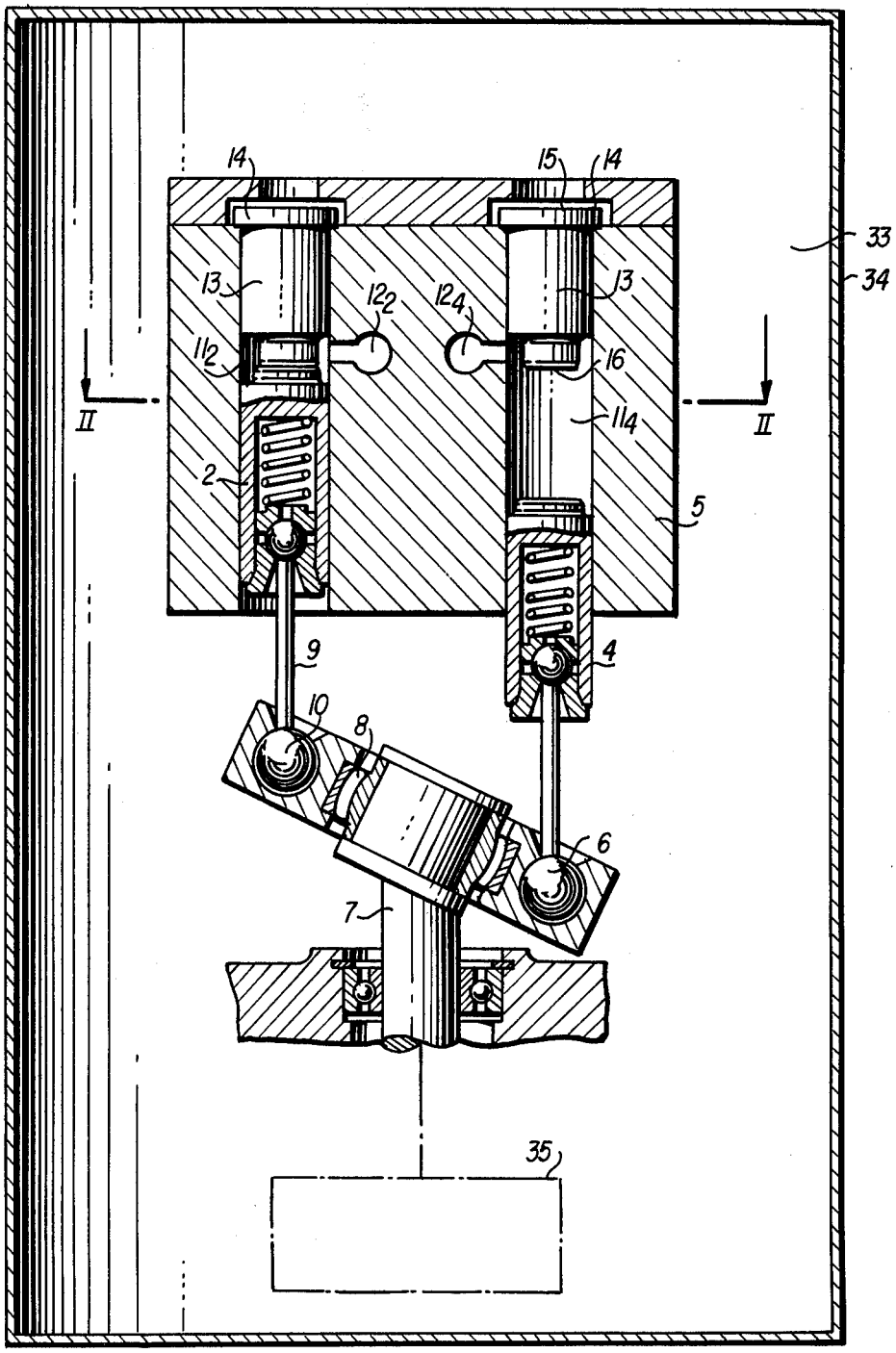

This application is a continuation-in-part of my copending application Ser. No. 558,559 filed Mar. 14, 1975 now abandoned.

The present invention relates to hydraulic engines which, as is known, work between a high pressure source and a low pressure source. In known engines of this type operation is controlled by pressurizing certain chambers.

In a piston engine for example, the fluid from the high pressure source is introduced into the working chambers comprising the base of the bores wherein the pistons slide. These pistons, which the fluid tends to move towards the outside of their bores, drive the mechanical members to which they transmit a motive force (transformed into a torque).

When the piston reaches the end of its extension stroke its working chamber is connected to the low pressure source, so that it can move towards the inside of the bore and expel the fluid from its working chamber.

All the movable members of the engine are generally immersed either in low pressure fluid or in a fluid at a drainage pressure which differs from the low pressure but which is in any case lower than the high pressure of the source.

The object of the invention is to reverse the functions of the high and low pressure, i.e. controlling the engine by placing certain working chambers under low pressure, instead of placing them under high pressure.

Thus, an engine according to the invention can be immersed in an enclosure filled with high pressure fluid without it being necessary to provide a higher pressure and rotary joints if the output shaft has to drive members which are themselves immersed in the enclosure.

In this specific case of barrel-type engines and digitally controlled axial pistons, i.e. engines whose positions are controlled step by step, each bore or working chamber has its own supply line and a selector switch external of the engine making it possible to switch over to the high or low pressure side the supply lines of the working chambers.

In the case of these engines the maximum pressures applied to the pistons at the end of each step lead to the application of maximum stresses to certain components of the engine, for example to attachment members, links, etc.

This advantage is obviated according to the invention through controlling engines of this type by connecting to low pressure the bores wherein the pistons are displaced.

To this end the invention provides for the arrangement of limited stroke thrust pistons having the same cross-section, for example flanged pistons, whose faces are subject to the same pressures as act on the respective faces of the associated control pistons, in the bores wherein slide the control pistons and opposite to the inclined plate so that all the force exerted by the fluid on the control piston during retraction is absorbed by the associated thrust piston, as from a clearly defined position of the said control piston.

Figure 2:
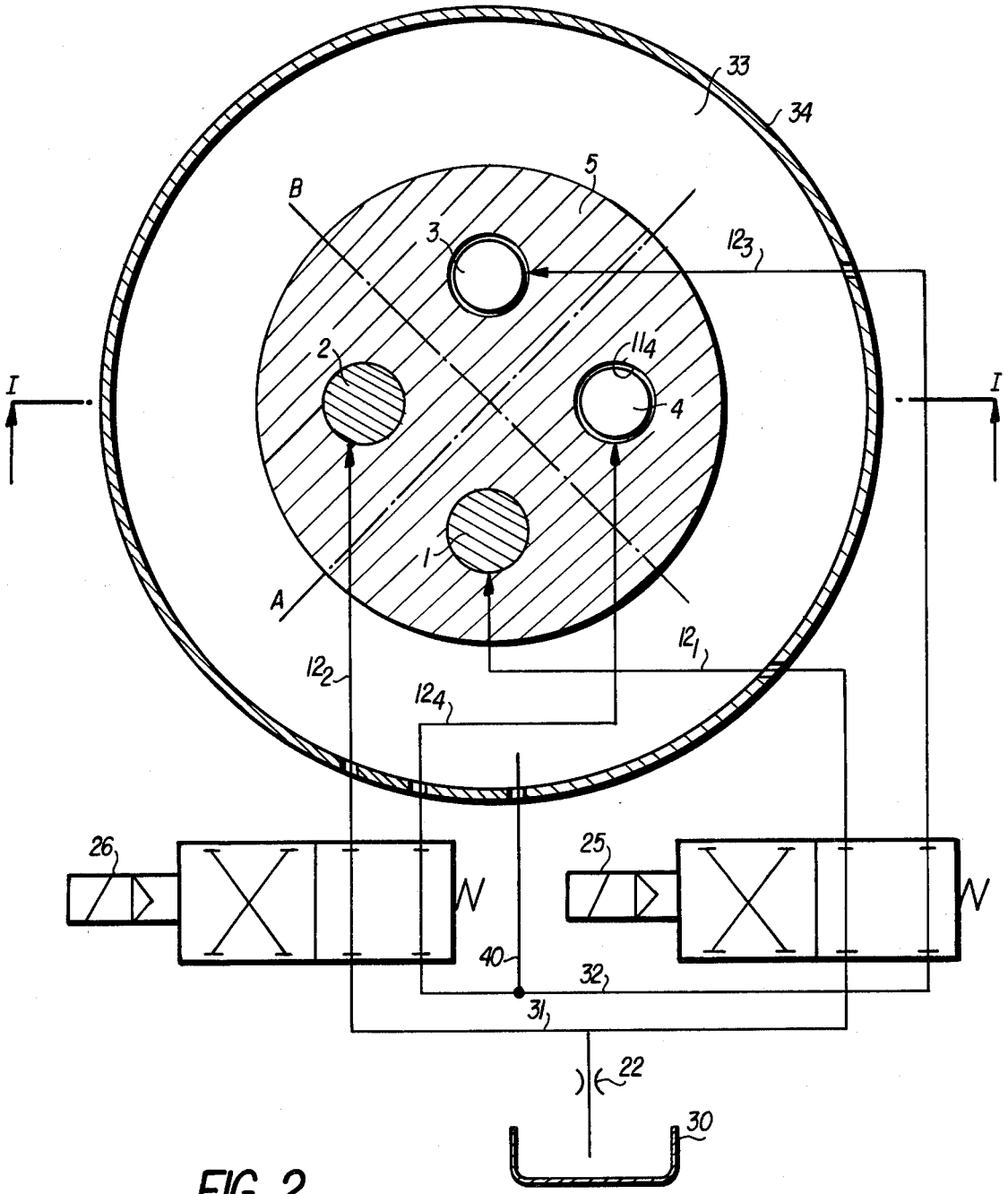

As a non-limitative example the attached drawings show a barrel-type engine and axial pistons having four positions per revolution. In the drawings show:

FIG. 1 a schematic view in axial section of the engine along the line I — I of FIG. 2.

FIG. 2 a sectional view along the line II — II of FIG. 1.

In the represented example the engine substantially comprises a fixed barrel 5 wherein slide four axial pistons 1, 2, 3, 4 of the same cross-section S arranged at 90° to one another and an inclined plate 6 mounted on the bent output shaft 7 via a deep grooved bearing 8. The engine is immersed in a fluid 33 of pressure $P_1$ enclosed in enclosure 34 the driven member 35 operatively connected to shaft 7 being also immersed in the fluid 33. Pistons 1, 2, 3, 4 are coupled to plate 6 by links 9 having spherical heads 10. Into each cylinder 11 issues a pipe 12 which can either be connected to the pressure $P_1$, i.e. here to the fluid 33 which fills the enclosure wherein the engine is immersed, or to a lower pressure. As shown in FIG. 2, pipes 12 are connected to line 31 or 32 and through these lines to the low pressure source 30 by the restriction 22 or to the high pressure by line 40.

When the chamber of a piston is connected to the low pressure, the said piston is subject to a retraction force which can attain $P_1S$, whereby the piston pulls on plate 6.

The pistons are controlled pairwise, each pair comprising two diametrically opposed pistons.

Thus, it can be seen from FIG. 2 that the distribution valve 25 controls the pistons 1 and 3 through lines $12_1$ and $12_3$ and that the valve 26 controls the pistons 2 and 4 through lines $12_2$ and $12_4$.

In each pair one piston is always active, i.e. chamber to low pressure, whilst the other is passive, i.e. chamber to high pressure. Thus, there are always two adjacent active pistons and two adjacent passive pistons.

Thus, plate 6 assumes the position with its high point in the bisecting plane of the dihedron defined by the planes of the two active pistons.

The movement is obtained by switching over the state of one pair. A commutation brings about a 90° rotation of the output shaft, whereby the direction of this rotation is dependent on the pair which has been switched over.

The following are the successive states of the pistons and therefore of plate 6:

When pistons 1 and 2 are active, i.e. their chamber being connected to low pressure and pistons 3 and 4 are passive, i.e. their chamber being connected to high pressure $P_1$ the high point A of plate 6 is in the bisecting plane of the dihedron defined by the two pistons 1 and 2. Next it is pistons 2 and 3 which are active and pistons 4 and 1 passive, the high point passes to B and the shaft rotates by 90°. Subsequently pistons 3 and 4 are active and the shaft again rotates by 90°. As pistons 4 and 1 are active the shaft again rotates by 90°.

In bores 11 wherein slide the pistons and on the side opposite to the said pistons are placed pistons 13 having flanges 14, pistons 13 having the same cross-section S as pistons 1 - 4. On their upper face 15 they are subject to high pressure $P_1$ and on their lower face 16 to the pressure in bore 11, i.e. to the pressure applied to the associated piston 1, 2, 3 or 4.

When a piston 1 is activated, i.e. its chamber 12 is connected to low pressure, piston 13 is placed on barrel 5 by its flange with a force $P_1S$.

To prevent high stresses on stopping, the dimensional values are calculated so that piston 1 comes into contact with its associated piston 13 just before the shaft reaches its ideal position. The retraction force exerted by the fluid on piston 1 is therefore absorbed by piston 13.

Thus, no force passes via links 9, other than that required to overcome the opposing torque.

Thus, the forces exerted on the pistons by the theoretical stopping position are therefore zero and increase suddenly on the piston which leaves its thrust block when the true position differs from the theoretical position. This ensures a good positioning precision and the absence of stresses in the engine, other than those due to the forces necessary to overcome the opposing torque.

To avoid high stresses at the time of switching over (sudden acceleration and balancing of the pistons during activation and passivation) it is merely necessary to provide a restriction 22 on the low pressure pipe which limits the speed and acceleration, as well as ensuring the passivation of one piston prior to the activation of the other in the same pair, which prevents large forces passing into links 9 and bearing 8.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A hydraulic engine of the type comprising working chambers and working members having two working faces and movable in said chambers under the action of a working fluid for actuating the engine, said engine lying in a fluid under ambiant high pressure, whereby each of said working members is submitted on one working face to said ambiant high pressure and on the other working face to the pressure of the fluid in said working chamber, means being provided for connecting each of said working chambers in turn with an external low pressure source for moving the corresponding working members (working stroke) and with said ambiant high pressure (return stroke).

2. A hydraulic engine lodged inside an enclosure filled with a fluid under ambiant high pressure and comprising a barrel having at least three cylindrical bores having equal cross-sections and extending longitudinally through the barrel, said cylinders being disposed about the longitudinal axis of the barrel at equally spaced points, a piston slidably movable in each cylinder and having two working faces, one submitted to said ambiant high pressure and the other to the pressure of the fluid in said cylinder bore, an output shaft, a plate member and means for rotatably mounting the plate member on an end of the shaft at an angle which is inclined with respect to the longitudinal axis of the output shaft, means for securing said plate member to each of said pistons comprising linking rod members, means for alternately connecting said cylinder bores with an external low pressure source and with said ambiant high pressure whereby said pistons are activated by fluid in the cylinder bores under pressure lower than that of the surrounding fluid and then are held passive by fluid in the cylinder bores at a pressure about equal to the pressure of the surrounding fluid while other pistons are alternately sequentially inactive and active under similarly alternately applied pressures in the cylinder bores and the output shaft is rotated each time pistons are activated.

3. A hydraulic engine lodged inside an enclosure filled with a fluid under ambiant high pressure and comprising a barrel having at least three cylindrical bores having equal cross-sections and extending longitudinally through the barrel, said cylinders being disposed about the longitudinal axis of the barrel at equally spaced points, a piston slidably movable in each cylinder and having two working faces, one submitted to said ambiant high pressure and the other to the pressure of the fluid in said cylinder bore, an output shaft, a plate member and means for rotatably mounting the plate member on an end of the shaft at an angle which is inclined with respect to the longitudinal axis of the output shaft, means for securing said plate member to each of said pistons comprising linking rod members, a second piston slidably disposed in each cylinder and having an annular radial flange which is of larger cross-section than the cylinder bore and rests on the barrel surface about the cylinder bore, means spaced longitudinally from the flanged end of the second piston for retaining it in its cylinder bore, means for alternately connecting said cylinder bores between its two pistons with an external low pressure source and with said ambiant high pressure whereby the pistons attached to the linking members are activated by fluid in the cylinder bores under pressure lower than that of the surrounding fluid and then are held passive by fluid in the cylinder bores at a pressure about equal to the pressure of the surrounding fluid while other pistons are alternately sequentially inactive and active under similarly alternately applied pressures in the cylinder bores and the output shaft is rotated each time pistons are activated.

* * * * *